US005778853A

United States Patent [19]

Saito

[11] Patent Number: 5,778,853

[45] Date of Patent: Jul. 14, 1998

[54] THROTTLE VALVE CONTROL DEVICE

[75] Inventor: Katsumi Saito, Asaka, Japan

[73] Assignee: Hadsys, Inc., Miyagi-ken, Japan

[21] Appl. No.: 815,859

[22] Filed: Mar. 12, 1997

[51] Int. Cl.[6] ..... F02D 7/00; F02D 41/00

[52] U.S. Cl. ..... 123/396; 123/361

[58] Field of Search ..... 123/361, 396, 123/399

[56] References Cited

U.S. PATENT DOCUMENTS

| | | | |
|---|---|---|---|
| 5,141,070 | 8/1992 | Hickman | 123/396 |
| 5,163,402 | 11/1992 | Taguchi | 123/396 |
| 5,168,951 | 12/1992 | Sugiura | 123/361 |
| 5,265,572 | 11/1993 | Kadomukai | 123/396 |
| 5,297,521 | 3/1994 | Sasaki | 123/396 |
| 5,447,133 | 9/1995 | Kamio | 123/396 |
| 5,524,589 | 6/1996 | Kikkawa | 123/296 |

FOREIGN PATENT DOCUMENTS

| | | | |
|---|---|---|---|
| 0306641 | 3/1989 | European Pat. Off. | 123/396 |
| 2-91432 | 3/1990 | Japan . | |
| 0057845 | 3/1991 | Japan | 123/361 |
| 3085338 | 4/1991 | Japan | 123/396 |
| 4-342834 | 11/1992 | Japan . | |
| 5-248273 | 9/1993 | Japan . | |

*Primary Examiner*—Carl S. Miller
*Attorney, Agent, or Firm*—Paul A. Guss

[57] ABSTRACT

A pedal side drive mechanism which is rotatable relative to a throttle shaft in both opening and closing directions is provided at one end of the throttle shaft. The throttle shaft opens and closes a throttle valve. A motor side drive mechanism, which is rotatable relative to the throttle shaft in both opening and closing directions, is provided at the other end of the throttle shaft. The pedal side drive mechanism and the motor side drive mechanism are able to be driven independently without interfering with each other, in both of the opening and closing directions of the throttle shaft. Accordingly, driving of the throttle can be performed using either the accelerator pedal or the motor, and functions including fail-safe measures or a limp home mode can be accomplished using a simple structure.

24 Claims, 7 Drawing Sheets

THROTTLE VALVE CONTROL DEVICE

BACKGROUND OF THE INVENTION

1. Field of the Invention

The present invention relates to a throttle valve control device which conducts various controls for a throttle shaft by human operation using an accelerator pedal, and by electric operation using a drive motor.

2. Description of the Related Art

A so-called electronic throttle, which is a type of throttle valve control device, has been known, and is made up of a suction throttle valve control device for use with an internal combustion engine in an automobile. Such a throttle valve control device electrically detects the amount by which the accelerator pedal is depressed, and thereby controls driving of an electric motor, and opening/closing of the throttle valve based on the amount, so as to maintain a reference number of rotations for the internal combustion engine.

Although this type of throttle valve control device enables a plurality of controls to be performed by a single motor, such as normal running, traction control, cruise control and idle control, when the motor and the accelerator pedal are operated jointly, it requires an arrangement in which both members do not interfere with each other, causing a considerably complicated structure for the entire throttle valve control device. The provision of a fail-safe function, which enables sufficient reliability when something is wrong with the throttle valve control device, or failure of other parts, has also been sought.

Accordingly, as disclosed in Japanese Laid-Open Patent Application No. 5-248273, a throttle valve control device for an internal combustion engine has been proposed. This device is able to produce, when an actuator drive system becomes out of order or results in any type of abnormal state, an auxiliary running condition so as to sufficiently reduce the possibility of uncontrolled running of the vehicle, using a fail-safe device. (This device is referred to as prior art No. 1 hereinafter.)

Similarly, a throttle actuator has been known as disclosed in Japanese Laid-Open Patent Application No. 4-342834. This device is equipped with a fail-safe function and a limp home mode function, which enable the vehicle to run safely should something be wrong with the vehicle. (This device is referred to as prior art No. 2 hereinafter.) A throttle valve opening and closing control device has also been known as disclosed in Japanese Laid-Open Patent Application No. 2-91432. This device includes a compensation mechanism for opening/closing, or completely closing, the throttle valve, by a throttle valve mechanical compensation means, when the electric opening and closing means for the throttle valve does not work properly. The compensation mechanism does not interfere with the electric throttle valve opening and closing operations during normal running of the vehicle. (This control device is referred to as prior art No. 3 hereinafter.)

However, prior art No. 1 results in a complicated structure, requiring a pair of lost motion springs at the accelerator pedal side, in addition to a return spring for the throttle valve shaft (or throttle shaft), although only a single motor achieves all the controls. In addition, electric operation of the motor is made primary, whereby idle control is driven and controlled in a throttle valve closing direction. Thereby, the motor remains energized during idling periods, in addition to during normal running, and hence damage to the motor by resistance heating can occur.

In prior art No. 2, the motor side is made primary in operation and includes a clutch, whereas the accelerator pedal side includes a throttle shaft lever, an accelerator lever, an adhering spring which corresponds to a lost motion spring, and a floating lever. Therefore, it has a disadvantage in that the drive mechanism at the pedal side becomes quite complicated. Moreover, the motor shaft includes a motor return spring which is always forced in a single direction (i.e. a completely closed direction) so as to release inertia from the motor side and manage breakdown of the clutch. Therefore, the motor shaft cannot return in the reverse direction (i.e. an opening direction), restricting the freedom of setting an initial position of the motor. In addition, an elastic force operates at the initial position, requiring a large motor torque.

Similar to prior art Nos. 1 and 2, prior art No. 3 makes the motor side primary in operation, but does not include a clutch, and therefore it is relatively simple in structure. However, the motor is directly connected to one side of the throttle shaft for operating the throttle valve; and the motor side drive mechanism and the accelerator pedal side drive mechanism center around this throttle shaft. Therefore, the throttle shaft is long on only one side thereof, so that it can cause vibration, distortion, and unwanted torsion and/or otherwise appears to be poor in balance.

In addition, since the motor is returned only by the throttle shaft return spring, it does not have sufficient reliability when the motor becomes out of order. Further, since the distance between the throttle shaft return spring and the motor is long, there are numerous intervening objects and it is difficult to remove inertia sufficiently. As a result, the throttle valve is prevented from returning promptly, causing poor response. Moreover, since the motor can return in only one direction by the throttle shaft return spring, the freedom of setting the initial position of the motor is restricted. Also, since the throttle shaft return spring requires a large force, a large motor torque is also needed.

As discussed above, in prior art Nos. 1 through 3, the joint use of a fail-safe function and a limp home mode function requires a more complicated structure at greater cost. In particular, it has been pointed out that, where the motor side is made primary in operation, and a single motor attempts to serve various functions, such as normal running, traction control, cruise and idle control, the structure of the operating system at the accelerator pedal side of the mechanism becomes significantly and disadvantageously complicated.

SUMMARY OF THE INVENTION

It is an object of the present invention to provide a throttle valve control device in which driving of a throttle shaft can be performed by both an accelerator pedal and a motor, and a fail-safe function and a limp home mode function are achieved using a simple structure.

According to the throttle valve control device of the present invention, the pedal side drive mechanism and the motor side drive mechanism are arranged so that they are rotatable relative to the throttle shaft in both opening and closing directions. The throttle shaft may be independently driven in both opening and closing directions without interference. Thus, an effective operation is secured, whether the accelerator pedal operation is made primary or the motor operation is made primary. For example, the throttle shaft can be driven by the pedal side drive mechanism connected to the accelerator pedal, whereas traction control, cruise control and idle control can be auxiliarily controlled by the motor side drive mechanism.

Hereupon, the motor side drive mechanism includes a motor initial position reset means for generating an elastic force so as to reset the motor to the initial set position from both the throttle valve opening and closing directions. Therefore, when one of the wheels slips or skids while the vehicle is running with the accelerator pedal depressed, for example, a traction control starts driving the motor in a throttle valve closing direction. As soon as the traction control ends, the motor is elastically forced back toward the throttle valve opening direction, so as to reset the motor to its initial set position. When idle control, cruise control or normal running is initiated by the motor, the motor is driven in the throttle valve opening direction. When driving of the motor is stopped, the motor is elastically forced in the throttle valve closing direction and reset to its initial position.

In this way, when driving of the motor is stopped, the motor is elastically forced by the motor initial position reset means in a direction reverse to the direction in which the motor was just previously driven, thereby resetting the motor to its initial set position. Thereby, should something be wrong with the motor control system, or if electrical power to the motor is cut, the motor is always reset to its initial set position without negatively affecting accelerator pedal operation.

In addition to the aforementioned abnormal periods, during normal operation, the motor side drive mechanism, including the motor, is elastically forced to an initial reset position by driving and stopping the motor. Therefore, inertia does not influence accelerator pedal operation, enabling sufficient operability of the accelerator pedal, and satisfactory responsiveness to throttle valve opening and closing. In other words, whether the motor is driven in the throttle valve opening direction or the throttle valve closing direction, the motor receives a reset force and can be reset to its initial set position smoothly. No elastic force is applied in any direction to the motor when in its initial set position, and thus the motor side drive mechanism becomes advantageously simple in structure.

The motor side drive mechanism includes a drive gear, an idle gear and a driven gear, and the motor initial position reset means is provided between the idle gear and the device body. Therefore, it is unnecessary to require a large space, particularly for the motor initial position reset means, facilitating a compact design for the entire throttle valve control device.

According to the present invention, the motor initial position reset means includes a rotary engagement part, a fixed engagement part, and a coil spring which is engageable with the rotary engagement part when the idle gear rotates in the throttle valve opening and closing directions. Thereby, the motor initial position reset means is able to be kept small in size, and the motor may be reset in both directions by a single coil spring through the idle gear. No elastic force is applied by the coil spring to the motor at its initial set position, and thus no load is generated on the motor.

The initial position of the motor is set at a position where a contact surface in a dead zone groove of the driven gear at the throttle valve opening side approximately corresponds to an engagement member of the throttle shaft. Therefore, the motor is driven without delay in the throttle valve opening direction during idle control, cruise control, and normal running, thereby providing a desired responsiveness. During traction control, the throttle valve is opened by action of the accelerator pedal, and the engagement member of the throttle shaft moves along the dead zone groove of the driven gear to a position close to the contact surface at the throttle valve closing side. Thereby, when traction control is initiated, the distance between the engagement member of the throttle shaft and the contact surface of the throttle valve closing side of the driven gear becomes short, improving responsiveness.

According to the present invention, the pedal side drive mechanism includes a throttle lever, an accelerator lever, a return spring, and a lost motion spring, wherein both sides of the lost motion spring stand opposite to each other and are engageable with a second engagement part of the accelerator lever. When the accelerator pedal is operated in the opening direction, rotation of the accelerator lever engages the other end of the lost motion spring with a first engagement part of the throttle lever, rotating the throttle lever together with the accelerator lever in the throttle valve opening direction.

On the other hand, when the accelerator pedal is released, the accelerator lever is rotated in the throttle valve closing direction by the return spring, whereby the throttle lever is rotated, by the lost motion spring, together with the accelerator lever in the throttle valve closing direction.

When a slip or skid of a wheel is detected, and the motor side drive mechanism is driven to initiate traction control while the throttle lever and the accelerator lever are open, the accelerator lever maintains its open state and the throttle shaft rotates in the closing direction. Therefore, the throttle lever can rotate, independently of the accelerator lever, in the throttle valve closing direction while being engaged with the other end of the lost motion spring. Accordingly, when the motor is stopped so as to release traction control, the throttle lever is rotated by the elastic force of the lost motion spring, in a throttle valve opening direction up to a position where it becomes engaged with the accelerator lever.

In an attempt to start cruise control, the accelerator lever is held at a predetermined opening position, or a completely closed position, and only the throttle shaft is rotated by the motor in the throttle valve opening direction. The throttle lever is rotated in the throttle valve opening direction, while separated from the other end of the lost motion spring, thereby initiating cruise control. When cruise control is released, the throttle lever is rotated by the elastic force of the return spring in the throttle valve closing direction up to a position where it becomes engaged with the accelerator lever. Incidentally, in an attempt to initiate idle control, the accelerator lever and the throttle lever are located at completely closed positions, and in this state the throttle lever operates in a way similar to that of cruise control operation.

According to the present invention, an accelerator opening sensor lever is connected to the throttle lever through a link, and a lost motion spring is provided between the accelerator opening sensor lever and the accelerator lever. Thus, cruise control, traction control and idle control are easily conducted by a simple structure.

A plane part is provided for each of the first and second engagement parts at positions where they engage the other end of the lost motion spring. Thus, when the other end of the lost motion spring contacts the first and second engagement parts, any possible damage is prevented, improving the resistance of the lost motion spring.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
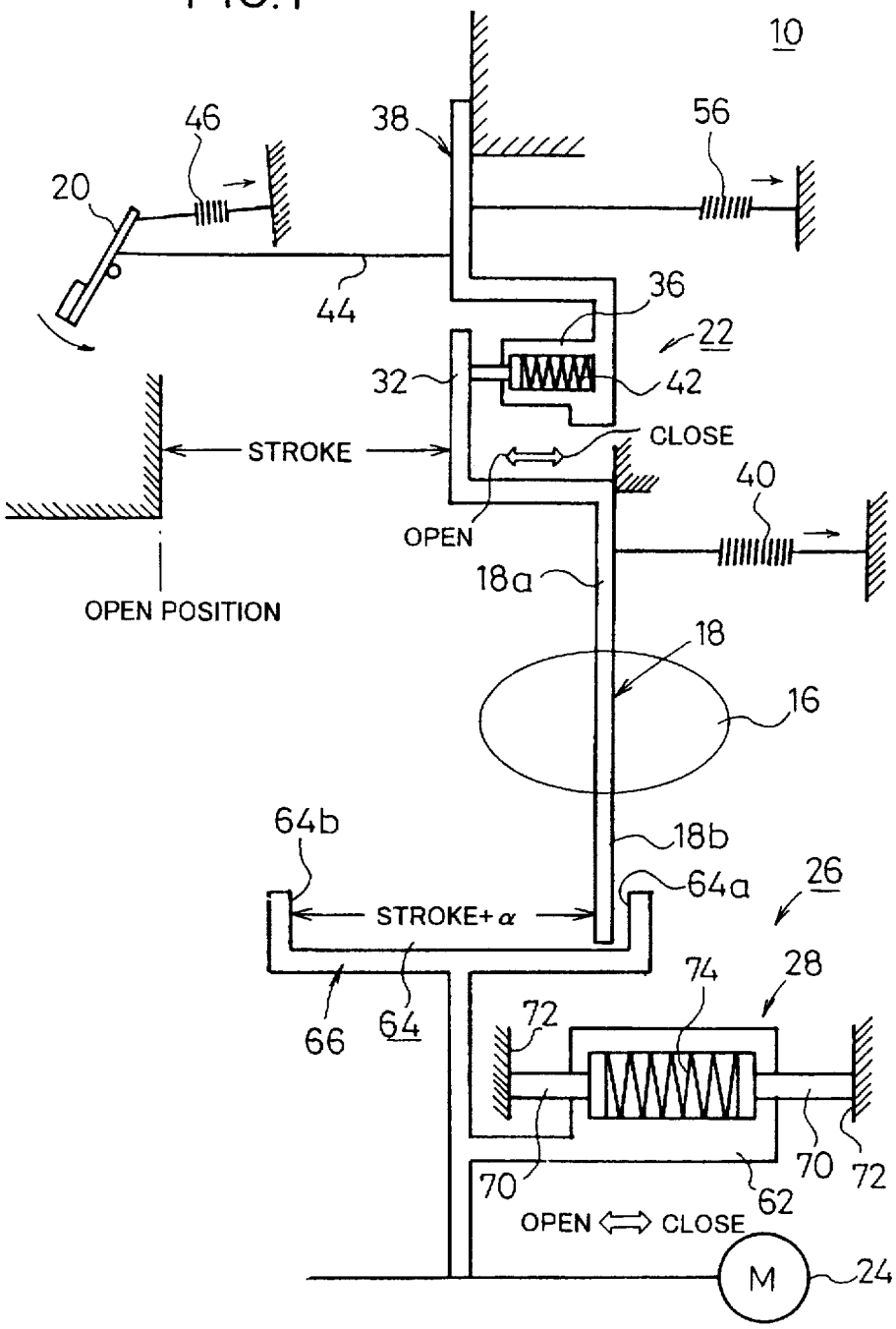
FIG. 1 is a conceptual diagram of a throttle valve control device according to a first embodiment of the present invention.
Figure 2:
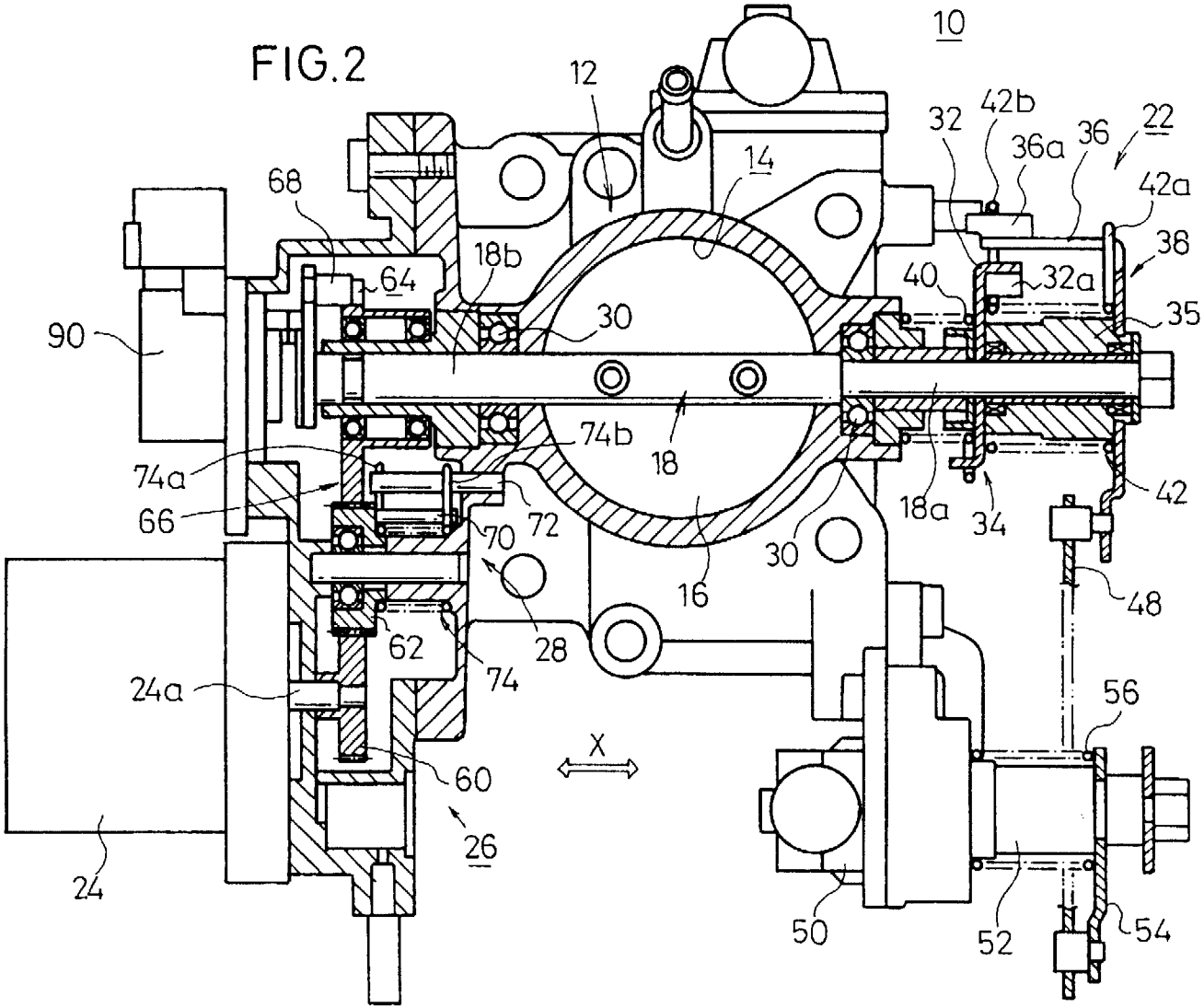
FIG. 2 is a partial sectional view of the throttle valve control device.

FIG. 1 is a conceptual diagram of a throttle valve control device 10 according to the first embodiment of the present invention. FIG. 2 is a partial sectional view of the throttle valve control device 10.

The throttle valve control device 10 is designed to control, by rotation of a throttle valve 16, the degree of opening of a passage 14 formed in the device body 12. Although the control device 10 is applicable not only to fuel injectors but also to carburetors, the first embodiment discusses only fuel injection.

The throttle valve control device 10 includes a pedal side drive mechanism 22 and motor side drive mechanism 26. The pedal side drive mechanism 22 is located at one end 18*a* of a throttle shaft 18 securing the throttle valve 16, and drives the throttle shaft by action of the accelerator pedal 20. The motor side drive mechanism 26 is located at the other end 18*b* of the throttle shaft 18 and drives the throttle shaft by action of a motor 24 (such as a stepping motor) which is rotatable in both forward and reverse directions. The motor side drive mechanism 26 includes a motor initial position reset means 28 for generating an elastic force so as to reset the motor 24 to an initial set position when the motor 24 is driven in both throttle valve opening and closing directions.

The throttle shaft 18 is rotatably supported by a device body 12 through a pair of bearings 20, and may be oval shaped in cross-section around one end 18*a* thereof. The pedal side drive mechanism 22 includes a throttle lever 34, an accelerator lever 38, a return spring 40 and a lost motion spring 42. The throttle lever 34 is fixed onto the one end 18*a* of the throttle shaft 18, and includes a first engagement part 32 which extends in an axial direction (i.e. the direction shown by arrow X in FIG. 2). The accelerator lever 38 is rotatably disposed around the one end 18*a* of the throttle shaft 18 through a spacer member 35, and has a second engagement part 36. The second engagement part 36 extends in the axial direction and is rotatable independently of the first engagement part 32. The return spring 40 is interposed between the throttle lever 34 and the device body 12, and serves to force the throttle lever 34 in the throttle valve closing direction. The lost motion spring 42 is interposed between the throttle lever 34 and the accelerator lever 38, and serves to enable relative rotation with respect to the motor side drive mechanism 26.

An elastic force of the lost motion spring 42 is set to be larger than that of the return spring 40. As shown in FIGS. 2 through 4A, one end 42*a* of the lost motion spring 42 is always engaged with the second engagement part 36 of the accelerator lever 38 so as to provide a bias in the throttle valve closing direction. The other end 42*b* of the lost motion spring 42 is engageable with at least one of the first engagement part 32 of the throttle lever 34 and the second engagement part 36, providing a bias in the throttle valve opening direction. The first engagement part 32 of the throttle lever 34 and the second engagement part 36 of the accelerator lever 38 include plane parts 32*a*, 36*a*, respectively (see FIG. 2), at portions where they are engageable with the other end 42*b* of the lost motion spring 42.

Figure 3:
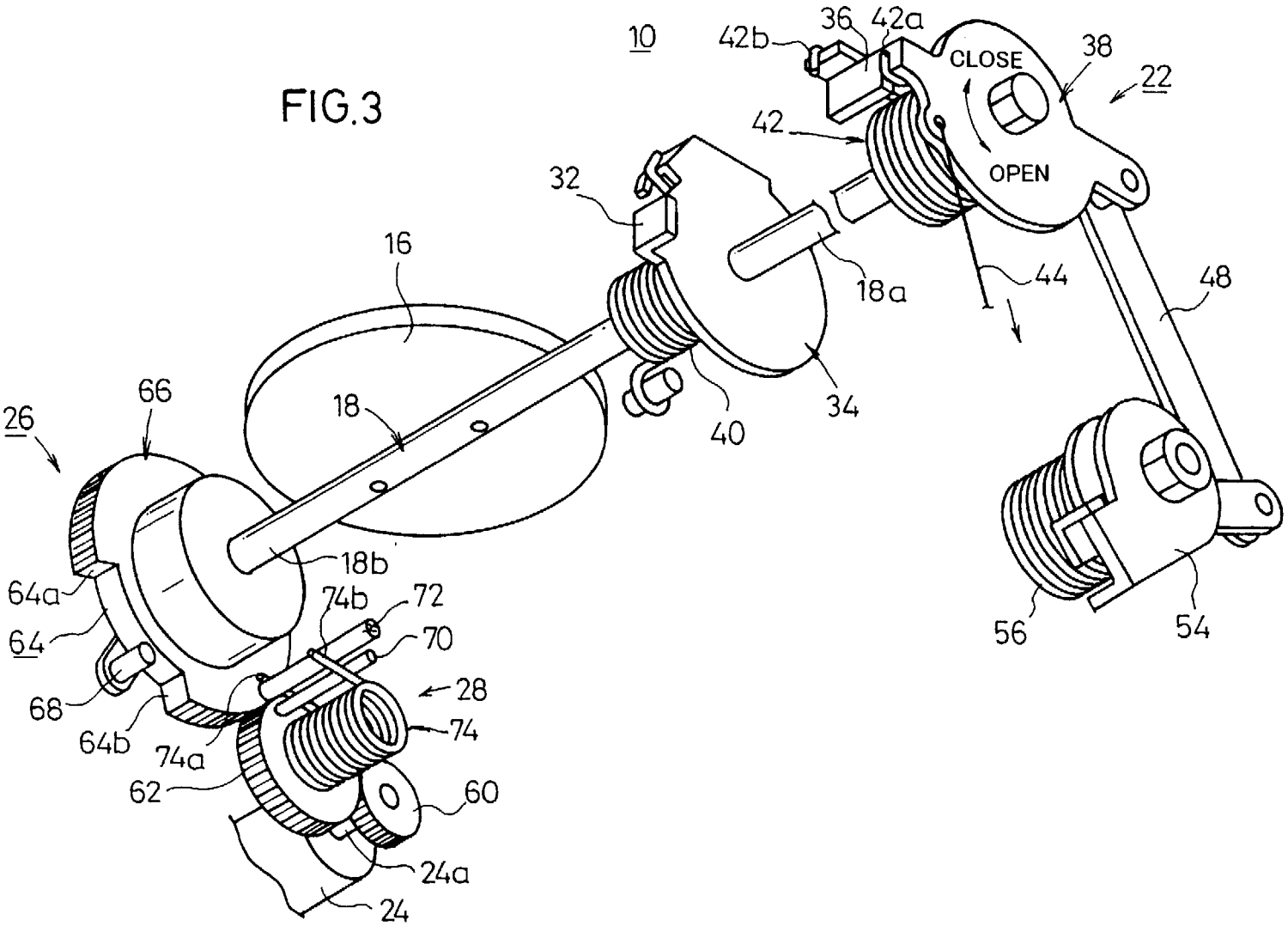
FIG. 3 is a perspective view for explaining an essential part of the throttle valve control device.

As shown in FIG. 1, the accelerator lever 38 is connected to the accelerator pedal 20 through a cable 44, and the accelerator pedal 20 is always forced in the direction indicated by the curved arrow by a spring 46. As shown in FIGS. 2 and 3, the accelerator lever 38 is engaged with one end of a link member 48, and the other end of the link member 48 is engaged with a sensor lever 54 which is connected in turn to an accelerator opening sensor shaft 52. The accelerator opening sensor shaft 52 is connected to an accelerator opening sensor 50. The sensor lever 54 also includes a sensor return spring 56.

As shown in FIGS. 2 and 3, the motor side drive mechanism 26 includes a drive gear 60, an idle gear 62, a driven gear 66 (see FIG. 5A) and an engagement pin 68 (which functions as an engagement member). The drive gear 60 is fixed onto a rotary shaft 24*a* of the motor 24. The idle gear 62 is rotatably disposed within the device body 12. The driven gear 66 rotatably supports the other end 18*b* of the throttle shaft 18, and has a dead zone groove 64 (see FIG. 3) enabling movement throughout an entire range, i.e. from a throttle valve completely open position to a throttle valve completely closed position. The engagement pin 68 is fixed onto the other end 18*b* of the throttle shaft 18 and is movable relative to the first and second contact surfaces 64*a*, 64*b* in the dead zone groove 64, as well as being movable along with the contact surfaces when in contact with them.

Figure 5A:
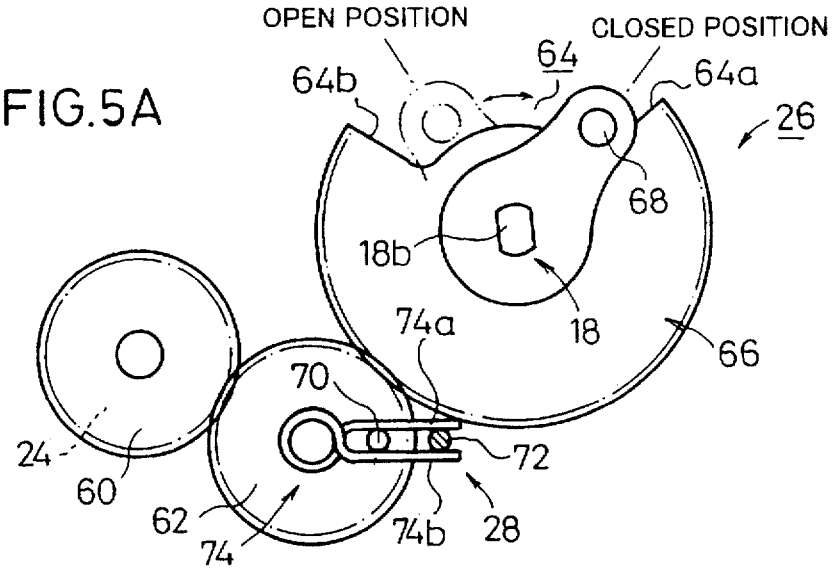
FIG. 5A is a view for explaining a state in which the motor is not driven.

The motor initial position reset means 28 is provided between the idle gear 62 and the device body 12, and includes a rotary pin 70 (which functions as a rotary engagement part) fixed onto a side surface of the idle gear 62, a fixed pin 72 (which functions as a fixed engagement part) provided at the side of the device body, and a coil spring 74 engageable with the rotary pin 70 when the idle gear 62 rotates in both throttle valve opening and closing directions. Both ends 74*a*, 74*b* of the coil spring are engageable with the fixed pin 72 on opposite sides thereof. The rotary pin 70 is also enclosed by both ends 74*a*, 74*b* and the outer circumferential region of the coil spring 74. The motor 24 is set at an initial set value, which corresponds to a position where the first contact surface 64*a* in the dead zone groove 64 of the driven gear 66, at the throttle valve opening side, approximately corresponds to a position of the engagement pin 68 in which the throttle shaft is in a minimum idle open position. (Such a position is shown in FIG. 5A.)

A description will now be given of the operation of the throttle valve control device 10 which is constituted as described hereinabove.

Figure 4A:
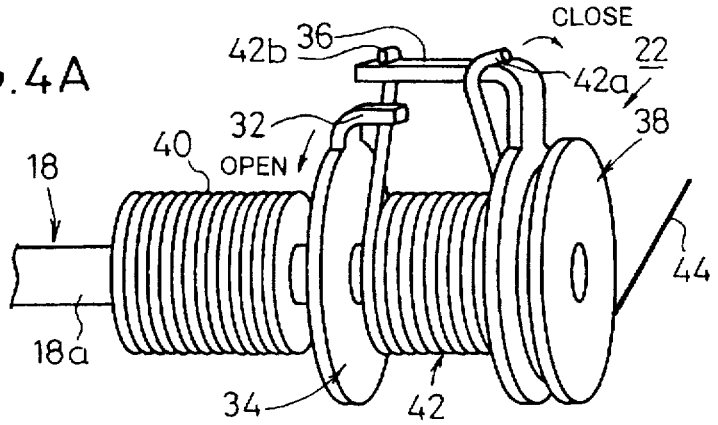
FIG. 4A is a view for explaining a throttle valve closing state.

First, referring to FIG. 4A, when the pedal side drive mechanism 22 is in an initial state, both ends 42*a*, 42*b* of the lost motion spring 42 are engaged with the second engagement part 36 of the accelerator lever 38, on opposite sides thereof, and the first engagement part 32 of the throttle lever nearly contacts, or is slightly spaced apart from, the other end 42b of the lost motion spring 42.

As shown in FIG. 1, when the accelerator pedal 20 is stepped on, this causes the accelerator pedal 20 to move in the direction reverse to the curved arrow, and the accelerator lever 38 is rotated by the cable in the throttle valve opening direction. Thereby, as shown in FIG. 4B, the other end 42b of the lost motion spring elastically forces the second engagement part 36 in the throttle valve opening direction, which rotates with the second engagement part 36 and contacts the first engagement part 32 of the throttle lever 34.

Hereupon, since the elastic force of the return spring 40 which elastically forces the throttle lever 34 in the throttle lever closing direction is set to be smaller than that of the lost motion spring 42, the throttle lever 34 is rotated in the throttle valve opening direction together with the accelerator lever 38 and the lost motion spring 42. As a consequence, the throttle shaft 18 which is fixed to the throttle lever 34 is rotated, and the throttle valve 16 fixed only to the throttle shaft 18 is rotated by a predetermined angle, increasing the opening of the passage 14 of the device body 12.

When the accelerator pedal 20 is released, the tensile force applied to the accelerator lever 38 by the cable 44 is released, wherein the accelerator lever 38 rotates in the throttle valve closing direction. The throttle lever 34 is rotated in the throttle valve closing direction by action of the return spring 40; and the throttle lever 34, the accelerator lever 38 and the lost motion spring 42 are rotated and returned together in the throttle valve closing direction. The accelerator lever 38 may also be rotated in the throttle valve closing direction by the elastic forces of each of the return spring 40 and the sensor return spring 56.

Figure 4B:
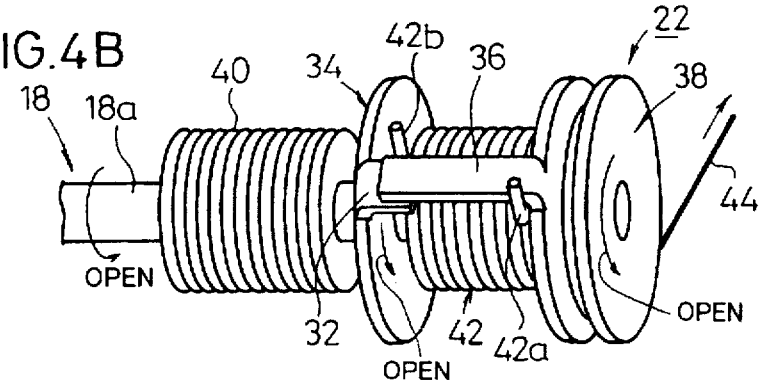
FIG. 4B is a view for explaining a state in which the accelerator pedal is pushed down.

Next, as shown in FIG. 4B, when a slip or skid of a wheel is detected while the accelerator lever 38 and the throttle lever 34 are maintained in an open state, the motor 24 is driven and traction control is initiated. As shown in FIG. 5A, when only the accelerator pedal is operated, the engagement pin 68 of the throttle shaft 18 merely moves along the dead zone groove 64 of the driven gear 66 from a completely closed position to a completely open position. Thus, no elastic force from the coil spring, which constitutes the motor initial position reset means 28, is applied to the motor 24.

Figure 5B:
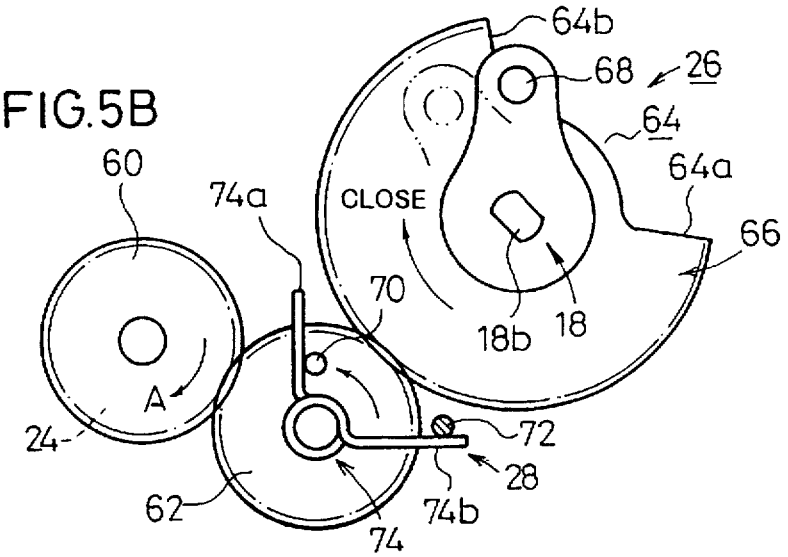
FIG. 5B is a view for explaining traction control.

As shown in FIG. 5B, when the motor 24 is driven and the drive gear 60 is rotated in the direction of the arrow A (i.e. the throttle valve closing direction) by the rotary shaft 24a, the idle gear 62 which is meshed with the drive gear 60 is rotated in the direction indicated by the arrow. Therefore, the rotary pin 70 provided on the idle gear 62 forcibly rotates the end 74a of the coil spring 74, generating a torsion force in the coil spring 74. Simultaneously, the driven gear 66 which is meshed with the idle gear 62 is rotated in the throttle valve closing direction, whereby the second contact surface 64b rotates the engagement pin 68 forcibly from the position shown by the two-dot-chain line to the position shown by the solid line in FIG. 5B. Thus, the throttle valve 16 fixed to the throttle shaft 18 rotates in a closing direction, initiating traction control.

Figure 4C:
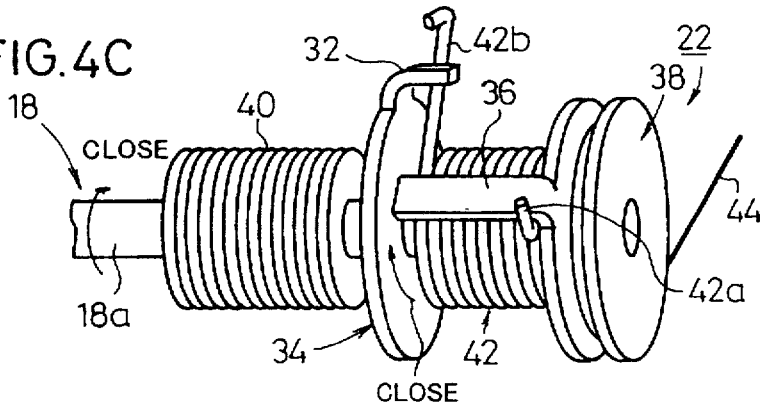
FIG. 4C is a view for explaining traction control.

On the other hand, in the pedal side drive mechanism 22, when the throttle shaft 18 is rotated in the throttle valve closing direction, as shown in FIG. 4C, the throttle lever 34 is rotated correspondingly in the throttle valve closing direction. Then, the first engagement part 32 moves and spaces the other end 42b of the lost motion spring 42 from the second engagement part 36 of the accelerator lever 38, and rotates the other end 42b in the throttle valve closing direction. Therefore, while the opening position of the accelerator lever 38 is maintained, the throttle lever 34 forcibly twists the other end 42b of the lost motion spring 42 in the throttle valve closing direction, without interfering with the accelerator lever 38.

When traction control ends and driving of the motor 24 is stopped, the idle gear 62 is forced in a direction reverse to the arrow shown in FIG. 5B, together with the rotary pin 70, by the elastic force of the coil spring 74, which constitutes the motor initial position reset means 28. Thereby, the idle gear 62, the drive gear 60 and the driven gear 66 are all reset to their initial set positions.

On the other hand, the pedal side drive mechanism 22 is relieved from the force which was applied to the throttle lever 34 in the throttle valve closing direction by the motor side drive mechanism 26 (as shown by the arrow in FIG. 4C). Thereby, the throttle lever 34 is rotated in the throttle valve opening direction by the elastic force of the lost motion spring 42. The throttle lever 34 is thus rotated and returned to the position where it connects with the accelerator lever 38 (as shown in FIG. 4B). Since the other end 42b of the lost motion spring 42 contacts the second engagement part 36 of the accelerator lever 38, the throttle lever 34 does not further rotate in the opening direction beyond the position where it connects with the accelerator lever 38.

Figure 5C:
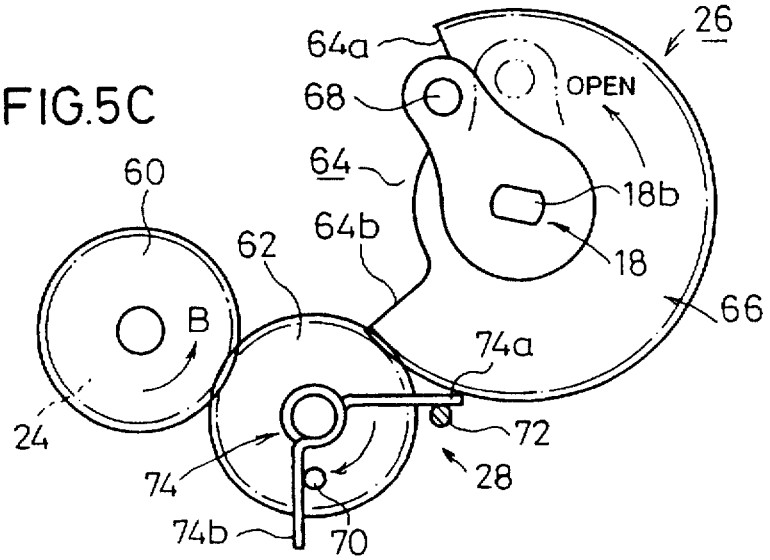
FIG. 5C is a view for explaining cruise control.

In an attempt to initiate cruise control, the accelerator lever 38 and the throttle lever 34 are maintained together at a certain opening position, and drive to the motor 24 is initiated. As a result, the drive gear 60 is rotated in the direction of arrow B (i.e. the throttle valve opening direction) as shown in FIG. 5C, and the idle gear 62 is rotated in the direction indicated by the arrow, while rotating the end 74b of the coil spring 74 by the rotary pin 70. The first contact surface 64a of the driven gear 66, which is meshed with the idle gear 62, rotates the engagement pin 68 together with the throttle shaft 18 in the throttle valve opening direction.

Figure 4D:
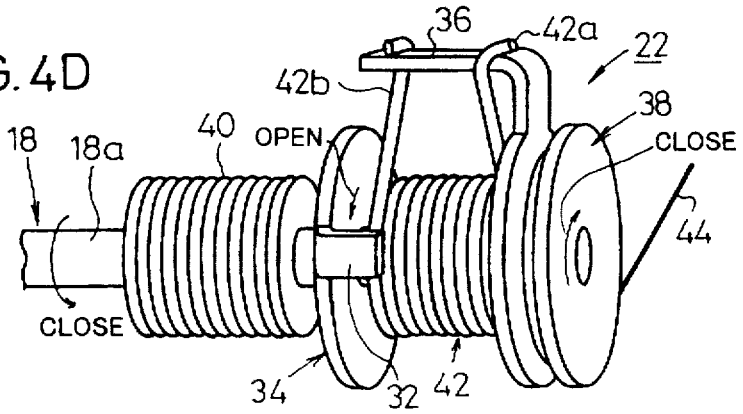
FIG. 4D is a view for explaining cruise control.

On the other hand, in the pedal drive mechanism 22, only the throttle lever 34 is rotated, as shown in FIG. 4D, in the throttle valve opening direction, whereas the accelerator lever 38 is returned to a certain opening position or to a predetermined position. Both ends 42a, 42b of the lost motion spring 42 are engaged only with the second engagement part 36 of the accelerator lever 38, whereas the first engagement part 32 of the throttle lever becomes separated from the lost motion spring 42. Thus, advantageously, the motor side drive mechanism 26 can be independently operated without negatively affecting the accelerator lever 38.

When cruise control is released, the idle gear 62 is rotated in the direction reverse to the arrow shown in FIG. 5C, by the elastic force of the coil spring 74 which constitutes the motor initial position reset means 28. As a consequence, the drive gear 60 and the driven gear 66, which are meshed with the idle gear 62, are rotated in the throttle valve closing direction and returned to their predetermined initial positions. On the other hand, in the pedal side drive mechanism 22, the throttle lever is rotated, by the restorative force of the return spring 40, to its original position, that is, the position where it connects with the accelerator lever 38 (see FIG. 4A).

In an attempt to initiate idle control, the accelerator lever 38 and the throttle lever 34 are each located at the completely closed position, as shown in FIG. 4A. The throttle valve 16 nevertheless remains slightly open at this completely closed position of the throttle lever 34, providing a minimum idle opening. Therefore, drive control by the motor 24 is not required during normal idle running. The motor 24 is driven and controlled only when a necessity arises, such as when a cold starting, or when a ventilator switch is turned on, so that the motor side drive mechanism 26 may increase the opening of the throttle valve, and hence the number of engine rotations.

As an alternative, another control is available where the throttle valve 16 is set to be at zero degrees of opening at the completely closed position of the throttle lever 34, and the valve is driven in the opening direction by operation of the motor 24, so as to provide the minimum number of engine rotations for idle. Still another alternative control is also available where the throttle valve provides a relatively large number of engine rotations at the completely closed position of the throttle lever 34, and is driven in the closing direction by operation of the motor 24 so as to provide the minimum number of engine rotations for idle.

According to the first embodiment, in the motor side drive mechanism 26, whether the motor 24 is driven in a forward direction or in a reverse direction, that is, in the throttle valve opening or throttle valve closing directions, once the motor 24 stops being driven, the coil spring 74 is moved, by the motor initial position reset means 28, to a position where the coil spring 74 does not apply any elastic forces in any direction (i.e. the initial set position). Therefore, when something goes wrong with the motor control system, the motor 24 is always returned, even if the motor is turned off, to the initial position, without negatively affecting operation of the accelerator pedal 20. Thus, smooth normal operation and control of the accelerator pedal 20 is secured throughout the entire operating range, from the throttle valve completely closed position to the throttle valve completely open position.

In addition, since the motor side drive mechanism 26 may be reset securely by the coil spring 74, the motor initial position reset means 28 has a simple structure which secures important fail-safe functions, and simplifies the device structure. Since the motor side drive mechanism 26 is returned to the initial set position by the coil spring 74 as soon as the motor 24 is stopped, inertia from the motor side drive mechanism 26 does not influence the operation of the accelerator pedal 20, advantageously providing the accelerator pedal 20 with excellent operability, and the throttle valve 16 has excellent opening and closing responsiveness. Moreover, no elastic forces are applied to the motor 24 in either the opening or closing directions whenever the motor side drive mechanism 26 is at its initial set position, thereby keeping the motor 24 in a neutral state and preventing undue loads on the motor 24.

In addition, the first embodiment provides, in the motor side drive mechanism 26, a drive gear 60, an idle gear 62 and a driven gear 66, while arranging the motor initial position reset means 28 between the idle gear 62 and the device body 12. Accordingly, a large accommodating space is not needed, particularly for the motor initial position reset means 28, facilitating a compact design and minimizing the overall size of the motor side drive mechanism 26.

The engagement pin 68 of the throttle shaft 18 nearly accords with the first contact surface **64*a* of the driven gear 66 on the opening direction side thereof, so that the initial set position of the motor 24 corresponds to the throttle valve completely closed position as well as the position for providing minimum idle opening. Based from this opening position, idle control of the throttle valve 16 in the opening direction, cruise control and normal running control are all made available. Thus, there is a meritorious effect in that the throttle valve 16 has satisfactory responsiveness since it may be driven in the opening direction without delay. In addition, since the minimum number of engine rotations for idle is determined from the completely closed position, it is unnecessary to energize the motor in this state, and the motor 24** need be energized only when an increase over this number of rotations is desired.

When traction control is initiated, the throttle valve 16 has generally already been opened by operation of the accelerator pedal 20. Under this condition, the engagement pin 68 fixed to the throttle shaft 18 moves along the dead zone groove 64 of the driven gear 66, and moves to a position relatively close to the second contact surface **64*b* at the closing side thereof. As a result, when traction control is initiated from this state, the second contact surface 64*b* contacts the engagement pin 68 as soon as the driven gear 66** rotates in the throttle valve closing direction, providing good responsiveness.

The motor initial position reset means 28 includes a single coil spring 74. The motor 24 can be reset, by the elastic force of the coil spring 74, to the predetermined initial set position in both forward and backward directions. Thus, the motor side drive mechanism 26 can be made small and simple, and the motor 24 does not have any load imposed thereon at the initial set position.

According to the first embodiment, the pedal side drive mechanism 22 and the motor side drive mechanism 26 may both move relatively along the throttle shaft 18, and thus are controllable independently. The pedal side drive mechanism 22 has a single lost motion spring 42, wherein one end **42*a* of the lost motion spring 42 is always engaged with the accelerator lever 38, and the other end of the lost motion spring 42 is engageable with at least one of the accelerator lever 38 and the throttle lever 34**.

The throttle lever 34 and the accelerator lever 38 may rotate in both opening and closing directions without interfering with each other. Therefore, various controls including traction control, cruise control and idle control, which are initiated by the motor side drive mechanism 26, do not adversely affect and are easily accommodated by the pedal side drive mechanism 22, which has an extremely simple structure. The first and second engagement parts 32, 36 include plane parts **32*a*, 36*a*, respectively, at positions where they are engageable with the other end 42*b* of the lost motion spring 42. Thus, the other end 42*b* of the lost motion spring 42 is prevented from becoming damaged when the other end 42*b* of the lost motion spring 42 moves between the first and second engagement parts 32 and 36**.

The above-described first embodiment is easily applicable not only to the aforementioned case, where operation of the accelerator pedal 20 is made primary, but also to a case in which driving of the motor 24 is made primary. In the latter case, the throttle valve control device 10 may use the same structure, requiring changes only in the control program. More specifically, alternatively the accelerator opening sensor 50 can detect the degree of opening of the accelerator lever 38 by operation of the accelerator pedal 20, and the motor 24 can be driven accordingly based on the detected result, so that opening of the throttle valve 16 corresponds to a preset reference number of engine rotations.

The opening of the throttle valve 16 is detected by the throttle opening sensor 90 provided at the other end **18*b* of the throttle shaft 18 (see FIG. 2). The opening is sequentially feedback controlled so that it may correspond to the set number of engine rotations. More concretely, the actual number of engine rotations, vehicle speed, slip amount of one or more wheels, temperature of the engine, load applied to the engine, the running state of the vehicle, electrical load, and the like, are detected by the sensor, and the result is input to the CPU so as to calculate optimal conditions. The CPU then outputs a drive signal to the motor 24**.

The relationship between the accelerator lever 38 and the throttle lever 34 in this case is the same as that in the aforementioned traction control, cruise control and idle control. Since operations of the accelerator pedal 20 and the motor 24 are always instantly dependent on each other, the motor 24, and the driven gear 66 connected to the motor 24, can rotate even during normal running periods. As a result, the engagement pin 68 of the throttle shaft 18 approximately corresponds to and contacts the first contact surface 64*a* of the driven gear 66, and hence there is no idle space between them.

Thus, according to the first embodiment, the throttle valve control device 10 is easily applicable to performing both driving operations of the accelerator pedal 20 and driving operations of the motor 24, whichever may be considered primary, requiring only that the control program be changed accordingly.

Although the first embodiment employs a single return spring 40 to return the throttle lever 34, it may employ a further return spring disposed outside of the return spring 40, providing a double return structure, or it may employ still another return spring on the side of the motor 24. The motor 24 is not limited to a stepping motor, but may also be a DC motor.

Figure 6:
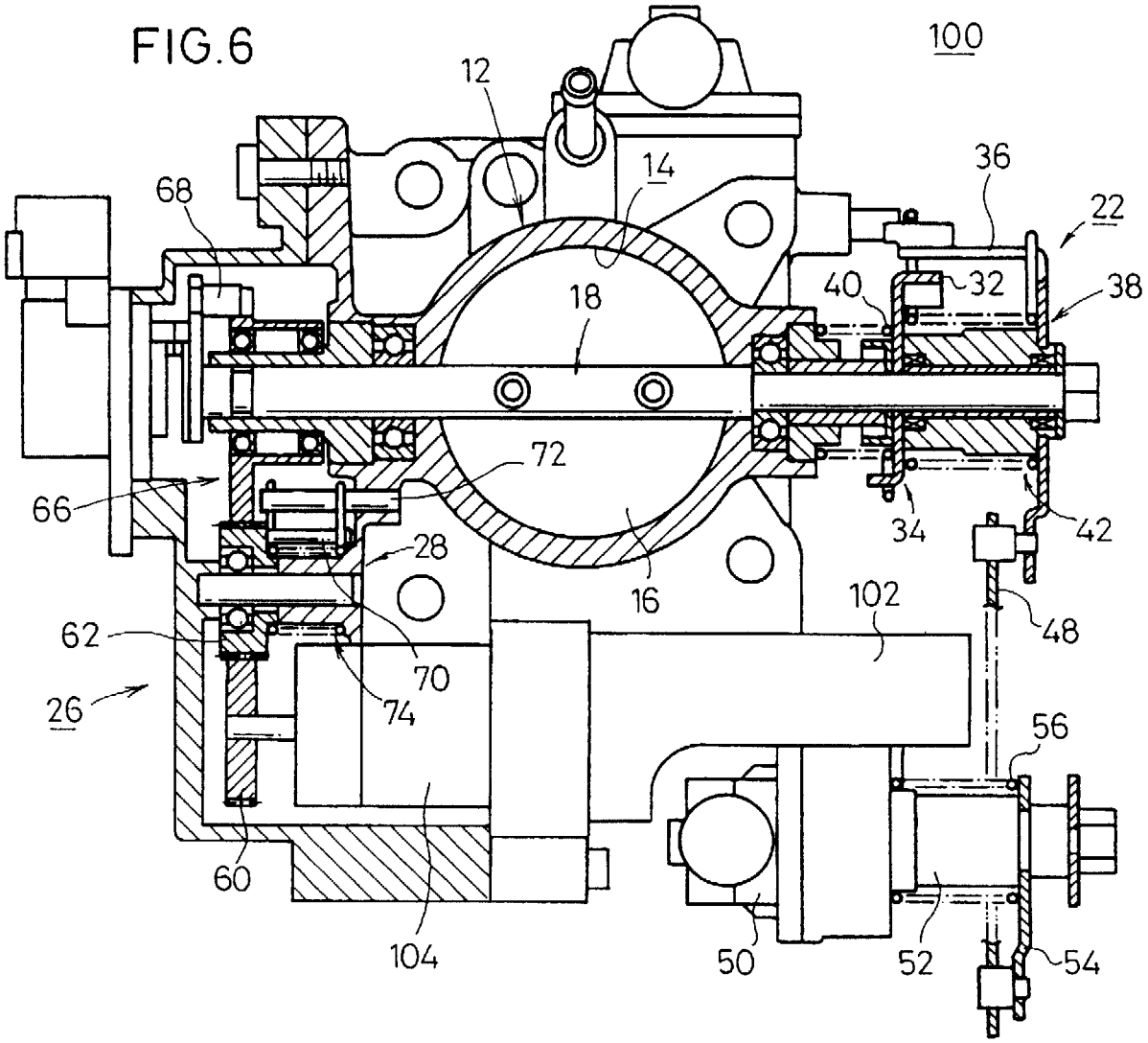
FIG. 6 is a partial sectional view for explaining a throttle valve control device according to a second embodiment of the present invention.

Next, with reference to FIG. 6, a description will be given of a throttle valve control device 100 according to a second embodiment of the present invention. Hereupon, those elements which are the same as elements in the throttle valve control device 10 of the first embodiment are designated by the same reference numerals, and detailed description thereof shall be omitted.

The throttle valve control device 100 includes a DC motor 102 in place of the motor 24, wherein the DC motor 102 is located with an orientation reverse to that of the motor 24, that is, on the same side on which the device body 12 is disposed. The DC motor is connected to a electromagnetic clutch 104.

Therefore, the throttle valve control device 100, in which the DC motor 102 is housed on the same side as the device body 12, becomes advantageously small in size. The DC motor 102 may also be replaced alternatively with a stepping motor.

Figure 7:
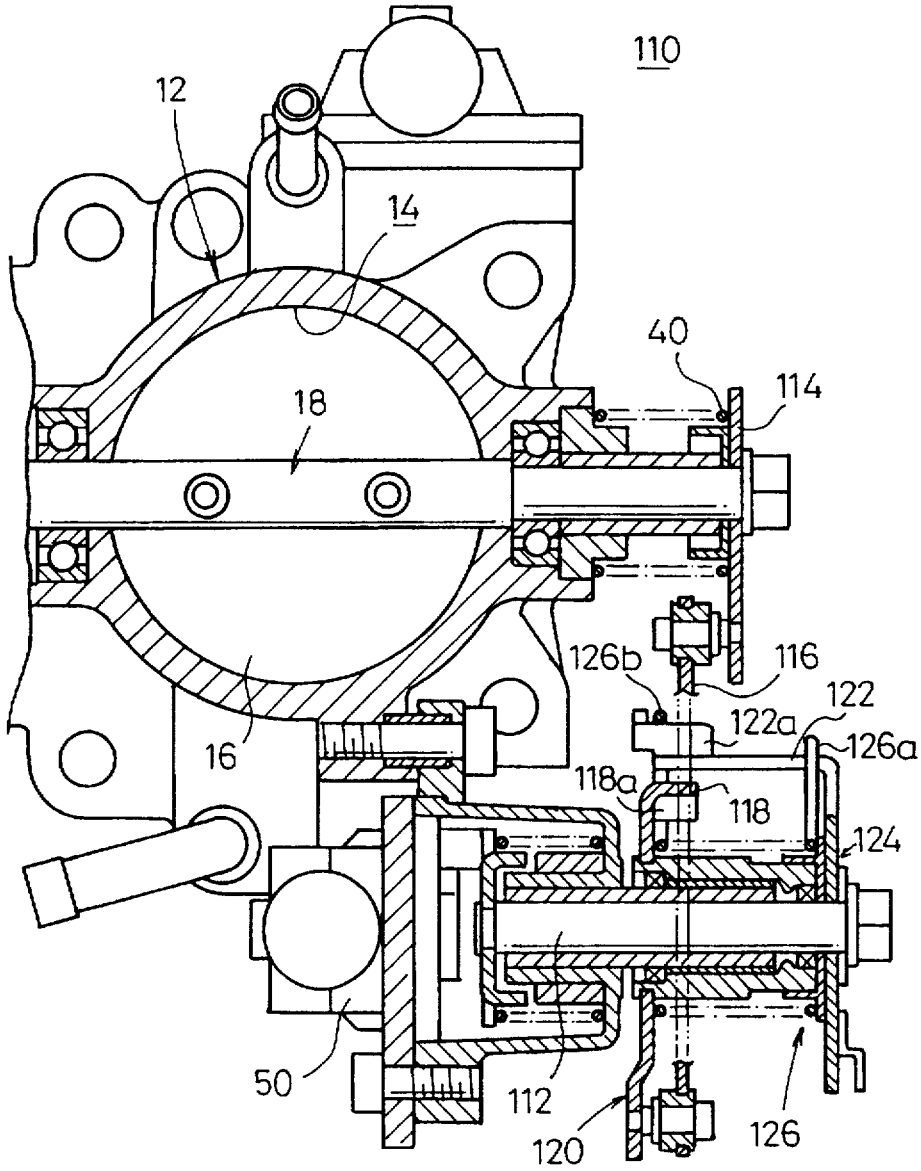
FIG. 7 is a partial sectional view for explaining a throttle valve control device according to a third embodiment of the present invention.

FIG. 7 is a partial sectional view of a throttle valve control device 110 according to a third embodiment of the present invention. Those elements which are the same as elements in the throttle valve control device 10 of the first embodiment are designated by the same reference numerals, and detailed description thereof shall be omitted.

The throttle valve control device 110 includes an accelerator opening sensor lever 120 rotatably disposed around an accelerator opening sensor shaft 112, and an accelerator lever 124 fixed onto the accelerator opening sensor shaft 112. The accelerator opening sensor lever 120 is rotatably coupled to a throttle lever 114 through a link member 116, and is provided with a first engagement part 118 which extends in the axial direction. The accelerator lever 124 includes a second engagement part 122 which extends in the axial direction and is rotatable independently of the first engagement part 118.

A lost motion spring 126 is inserted between the accelerator opening sensor lever 120 and the accelerator lever 124. One end 126*a* of the lost motion spring 126 is always engaged with the second engagement part 122 in the throttle valve closing direction, and the other end 126*b* of the lost motion spring 126 is engageable with at least one of the first engagement part 118 and the second engagement part 122 in the throttle valve opening direction. The first and second engagement parts 118, 122 further include plane parts 118*a*, 122*a*, respectively, at positions where they are engaged with the other end 126*b* of the lost motion spring 126.

In the throttle valve control device 110 of the third embodiment, when the accelerator lever 124 is rotated in the throttle valve opening direction by operation of an unillustrated accelerator pedal, the accelerator opening sensor lever 120 is rotated in the throttle valve opening direction by the first engagement part 118 which is engaged with the other end 126*b* of the lost motion spring 126.

Next, the throttle lever 114, which is engaged with the accelerator opening sensor lever 120 through the link member 116, rotates together with the throttle shaft 18 against the force of the return spring 40, increasing the opening of the throttle valve 16.

In an attempt to initiate traction control or cruise control, the throttle lever 114 is rotated together with the throttle shaft 18 in the throttle valve opening or closing directions by the motor side drive mechanism (not shown), whereby the accelerator opening sensor lever 120 is rotated independently of the accelerator lever 124 by the link member 116. Thereby, effects similar to the throttle valve control device 10 of the first embodiment are achieved.

What is claimed is:

1. A throttle valve control device comprising:

a pedal side drive mechanism, provided at one end of a throttle shaft which opens and closes a throttle valve, said pedal side drive mechanism being rotatable relative to the throttle shaft in both opening and closing directions;

a motor side drive mechanism provided at another end of the throttle shaft, said motor side drive mechanism being rotatable relative to the throttle shaft in both of said opening and closing directions, wherein said motor side drive mechanism includes motor initial position reset means for generating an elastic force to reset the motor to an initial set position after the motor has been driven in one of the throttle valve opening and closing directions, wherein said pedal side drive mechanism and said motor side drive mechanism are able to be independently driven without interfering with each other in both of said opening and closing directions.

2. A throttle valve control device according to claim 1, wherein said motor side drive mechanism includes:

a drive gear fixed to a rotary shaft of the motor;

an idle gear rotatably provided on a device body;

a driven gear which rotatably supports the other end of the throttle shaft and includes a dead zone groove permitting movement of the throttle shaft throughout a range from a throttle valve completely open position to a throttle valve completely closed position; and an engagement member fixed onto the throttle shaft, said engagement member being movable relative to a pair of contact surfaces in said dead zone groove, and movable together with said contact surfaces when in contact therewith.

3. A throttle valve control device according to claim 2, wherein said motor initial position reset means includes:

a rotary engagement part provided on said idle gear;

a fixed engagement part provided on the device body; and a coil spring, both ends of which are engageable with said fixed engagement part on opposite sides thereof, said rotary engagement part being enclosed by said both ends and an outer circumferential part of said coil spring, and said rotary engagement part being engageable with said coil spring when said idle gear rotates in the throttle valve opening and closing directions.

4. A throttle valve control device according to claim 2, wherein the initial set position of the motor is set to be a position where opening side surface of the dead zone groove of said driven gear approximately corresponds to the engagement member of the throttle shaft.

5. A throttle valve control device according to claim 1, wherein said motor initial position reset means includes:

a rotary engagement part which is rotatable by the motor;

a fixed engagement part which is provided on the device body;

a coil spring, both ends of which are engageable with said fixed engagement part on opposite sides thereof, said rotary engagement part being enclosed by said both ends and an outer circumferential part of said coil spring, and said rotary engagement part being engageable with said coil spring when said motor rotates in the throttle valve opening and closing directions.

6. A throttle valve control device according to claim 1, wherein said pedal side drive mechanism includes:

a throttle lever which is fixed to the throttle shaft and includes a first engagement part which extends in an axial direction;

an accelerator lever which is rotatably disposed on the throttle shaft and includes a second engagement part which extends in an axial direction;

a return spring provided between said throttle lever and the device body, said return spring applying a force to said throttle lever in the throttle valve closing direction; and a lost motion spring provided between said throttle lever and said accelerator lever, said lost motion spring enabling relative rotation of said accelerator lever with respect to said motor side drive mechanism, wherein one end of said lost motion spring is always engaged with the second engagement part while applying a bias in the throttle valve closing direction, and wherein another end of said lost motion spring is engageable with at least one of the first and second engagement parts while applying a bias in the throttle valve opening direction.

7. A throttle valve control device according to claim 6, wherein an elastic force of said lost motion spring is greater than an elastic force of said return spring.

8. A throttle valve control device according to claim 6, wherein said first and second engagement parts each include a plane part at a portion engageable with said other end of said lost motion spring.

9. A throttle valve control device according to claim 1, wherein said pedal side drive mechanism includes:

a throttle lever fixed onto the throttle shaft;

an accelerator opening sensor lever rotatably disposed around an accelerator opening sensor shaft, said accelerator opening sensor lever being connected to and rotatable with said throttle lever via a link, and including a first engagement part which extends in an axial direction;

an accelerator lever which is fixed onto said accelerator opening sensor lever and which includes a second engagement part which extends in the axial direction and is rotatable independently of the first engagement part;

a return spring provided between said throttle lever and the device body, said return spring applying a force to said throttle lever in the throttle valve closing direction; and a lost motion spring provided between said accelerator opening sensor lever and said accelerator lever, said lost motion spring enabling relative rotation of said accelerator lever with respect to the motor side drive mechanism, wherein one end of said lost motion spring is always engaged with the second engagement part while applying a bias in the throttle valve closing direction, and wherein another end of said lost motion spring is engageable with at least one of the first and second engagement parts while applying a bias in the throttle valve opening direction.

10. A throttle valve control device according to claim 9, wherein an elastic force of said lost motion spring is greater than an elastic force of said return spring.

11. A throttle valve control device according to claim 9, wherein said first and second engagement parts each include a plane part at a portion engageable with said other end of said lost motion spring.

12. A throttle valve control device according to claim 6, wherein said motor side drive mechanism includes:

a drive gear fixed to a rotary shaft of a motor;

an idle gear rotatably provided on the device body;

a driven gear which rotatably supports the throttle shaft and includes a dead zone groove permitting movement of the throttle shaft throughout a range from a throttle valve completely open position to a throttle valve completely closed position; and an engagement member fixed onto the throttle shaft, said engagement member being movable relative to a pair of contact surfaces in said dead zone groove, and movable together with said contact surfaces when in contact therewith, wherein said motor initial position reset means includes:

a rotary engagement part provided on said idle gear;

a fixed engagement part provided on the device body; and a coil spring, both ends of which are engageable with said fixed engagement part on opposite sides thereof, said rotary engagement part being enclosed by said both ends and an outer circumferential part of said coil spring, and said rotary engagement part being engageable with said coil spring when said idle gear rotates in the throttle valve opening and closing directions.

13. A throttle valve control device according to claim 9, wherein said motor side drive mechanism includes:

a drive gear fixed to a rotary shaft of a motor;

an idle gear rotatably provided on the device body;

a driven gear which rotatably supports the throttle shaft and includes a dead zone groove permitting movement of the throttle shaft throughout a range from a throttle valve completely open position to a throttle valve completely closed position; and an engagement member fixed onto the throttle shaft, said engagement member being movable relative to a pair of contact surfaces in said dead zone groove, and movable together with said contact surfaces when in contact therewith, wherein said motor initial position reset means includes:

a rotary engagement part provided on said idle gear;

a fixed engagement part provided on the device body; and a coil spring, both ends of which are engageable with said fixed engagement part on opposite sides thereof, said rotary engagement part being enclosed by said both ends and an outer circumferential part of said coil spring, and said rotary engagement part being engageable with said coil spring when said idle gear rotates in the throttle valve opening and closing directions.

14. A throttle valve control device comprising:

a pedal side drive mechanism, provided at one end of a throttle shaft which opens and closes a throttle valve, said pedal side drive mechanism being rotatable relative to the throttle shaft in both opening and closing directions;

a motor side drive mechanism provided at another end of the throttle shaft and a motor continuously engaged with said motor side drive mechanism, wherein during normal operation of said motor said motor side drive mechanism and said throttle shaft are rotatable relative to each other such that said shaft is rotatable by said pedal side drive mechanism in both of said opening and closing directions while said motor side drive mechanism remains stationary, and further wherein said motor side drive mechanism is capable of rotating said shaft in both opening and closing directions, wherein said pedal side drive mechanism and said motor side drive mechanism are able to be independently driven without interfering with each other in both of said opening and closing directions.

15. A throttle valve control device according to claim 14, wherein said motor side drive mechanism includes motor initial position reset means for generating an elastic force to reset the motor to an initial set position after the motor has been driven in one of the throttle valve opening and closing directions.

16. A throttle valve control device according to claim 15, wherein said motor side drive mechanism includes:

a drive gear fixed to a rotary shaft of the motor;

an idle gear rotatably provided on a device body;

a driven gear which rotatably supports the other end of the throttle shaft and includes a dead zone groove permitting movement of the throttle shaft throughout a range from a throttle valve completely open position to a throttle valve completely closed position; and an engagement member fixed onto the throttle shaft, said engagement member being movable relative to a pair of contact surfaces in said dead zone groove, and movable together with said contact surfaces when in contact therewith.

17. A throttle valve control device according to claim 16, wherein said motor initial position reset means includes:

a rotary engagement part provided on said idle gear;

a fixed engagement part provided on the device body; and a coil spring, both ends of which are engageable with said fixed engagement part on opposite sides thereof, said rotary engagement part being enclosed by said both ends and an outer circumferential part of said coil spring, and said rotary engagement part being engageable with said coil spring when said idle gear rotates in the throttle valve opening and closing directions.

18. A throttle valve control device according to claim 16, wherein the initial set position of the motor is set to be a position where an opening side surface of the dead zone groove of said driven gear approximately corresponds to the engagement member of the throttle shaft.

19. A throttle valve control device according to claim 14, wherein said pedal side drive mechanism includes:

a throttle lever which is fixed to the throttle shaft and includes a first engagement part which extends in an axial direction;

an accelerator lever which is rotatably disposed on the throttle shaft and includes a second engagement part which extends in an axial direction;

a return spring provided between said throttle lever and the device body, said return spring applying a force to said throttle lever in the throttle valve closing direction; and a lost motion spring provided between said throttle lever and said accelerator lever, said lost motion spring enabling relative rotation of said accelerator lever with respect to said motor side drive mechanism, wherein one end of said lost motion spring is always engaged with the second engagement part while applying a bias in the throttle valve closing direction, and wherein another end of said lost motion spring is engageable with at least one of the first and second engagement parts while applying a bias in the throttle valve opening direction.

20. A throttle valve control device according to claim 19, wherein an elastic force of said lost motion spring is greater than an elastic force of said return spring.

21. A throttle valve control device according to claim 19, wherein said first and second engagement parts each include a plane part at a portion engageable with said other end of said lost motion spring.

22. A throttle valve control device according to claim 14, wherein said pedal side drive mechanism includes:

a throttle lever fixed onto the throttle shaft;

an accelerator opening sensor lever rotatably disposed around an accelerator opening sensor shaft, said accelerator opening sensor lever being connected to and rotatable with said throttle lever via a link, and including a first engagement part which extends in an axial direction;

an accelerator lever which is fixed onto said accelerator opening sensor lever and which includes a second engagement part which extends in the axial direction and is rotatable independently of the first engagement part;

a return spring provided between said throttle lever and the device body, said return spring applying a force to said throttle lever in the throttle valve closing direction; and a lost motion spring provided between said accelerator opening sensor lever and said accelerator lever, said lost motion spring enabling relative rotation of said accelerator lever with respect to the motor side drive mechanism, wherein one end of said lost motion spring is always engaged with the second engagement part while applying a bias in the throttle valve closing direction, and wherein another end of said lost motion spring is engageable with at least one of the first and second engagement parts while applying a bias in the throttle valve opening direction.

23. A throttle valve control device according to claim 22, wherein an elastic force of said lost motion spring is greater than an elastic force of said return spring.

24. A throttle valve control device according to claim 22, wherein said first and second engagement parts each include a plane part at a portion engageable with said other end of said lost motion spring.

* * * * *